US005350052A

United States Patent [19]

Gebald et al.

[11] Patent Number: 5,350,052

[45] Date of Patent: Sep. 27, 1994

[54] DEVICE FOR TRANSPORTING AND EXCHANGING CONTAINERS OF TEXTILE STRAND MATERIAL

[75] Inventors: Gregor Gebald; Manfred Langen, both of Moenchengladbach, Fed. Rep. of Germany

[73] Assignee: Innovatex Materials Handling GmbH, Moenchengladbach, Fed. Rep. of Germany

[21] Appl. No.: 100,761

[22] Filed: Aug. 2, 1993

[30] Foreign Application Priority Data

Aug. 1, 1992 [DE] Fed. Rep. of Germany ..... 9210330

[51] Int. Cl.[5] ..... B65G 25/00

[52] U.S. Cl. ..... 198/465.2; 198/580; 198/720; 198/744; 242/35.5 A; 57/281

[58] Field of Search ..... 198/465.2, 580, 742–744, 198/748, 720; 242/5.5 A; 57/281

[56] References Cited

U.S. PATENT DOCUMENTS

| | | | |
|---|---|---|---|
| 2,225,532 | 12/1940 | Decker | 198/744 |
| 2,751,061 | 6/1956 | Nickerson | 198/742 |
| 2,891,659 | 6/1959 | Westeren | 198/744 |
| 3,033,349 | 5/1962 | Pockman et al. | 198/580 |
| 3,125,782 | 3/1964 | Kaino et al. . | |
| 3,716,979 | 2/1973 | Hadschuh et al. . | |
| 3,809,208 | 5/1974 | Shields | 198/465.2 |
| 3,999,671 | 12/1976 | Lutz | 198/465.2 |
| 5,115,631 | 5/1992 | Gebald et al. | 198/742 |
| 5,179,829 | 1/1993 | Grecksch et al. | 242/35.5 A |

FOREIGN PATENT DOCUMENTS

| | | | |
|---|---|---|---|
| 1206053 | 1/1986 | U.S.S.R. | 198/465.2 |

*Primary Examiner*—Joseph E. Valenza
*Attorney, Agent, or Firm*—Shefte, Pinckney & Sawyer

[57] ABSTRACT

An apparatus for transporting and exchanging containers of textile strand material at a textile strand processing machine having a plurality of processing stations is disclosed. The device includes a guide device for guiding containers around the machine. An endless drive connection reciprocally movable in the transport path and having flexible portions reciprocally movable through the corner sections of the transport path is included as well as a drive means for reciprocally driving the drive connection. Container engaging elements are also provided for drivingly engaging containers during movement of the drive connection. The drive connection may include rods disposed in the straight portions of the transport path which are connected to the flexible portions. The container engaging elements may comprise pawls mounted on transverse shafts which may be spring biased into the container engaging dispositions. The drive may act directly on at least one of the rods, a sprocket located at the corner sections and the flexible portions.

11 Claims, 2 Drawing Sheets

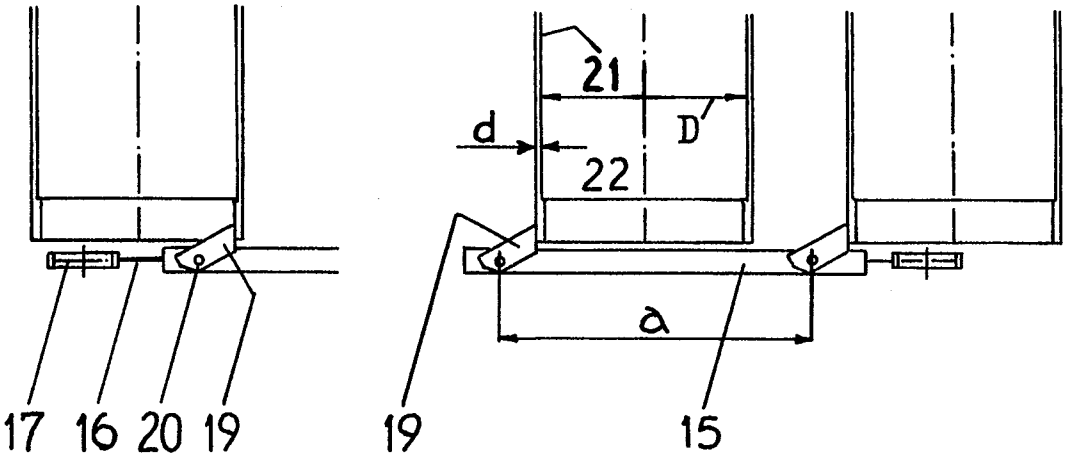
FIG. 2A
FIG. 2B
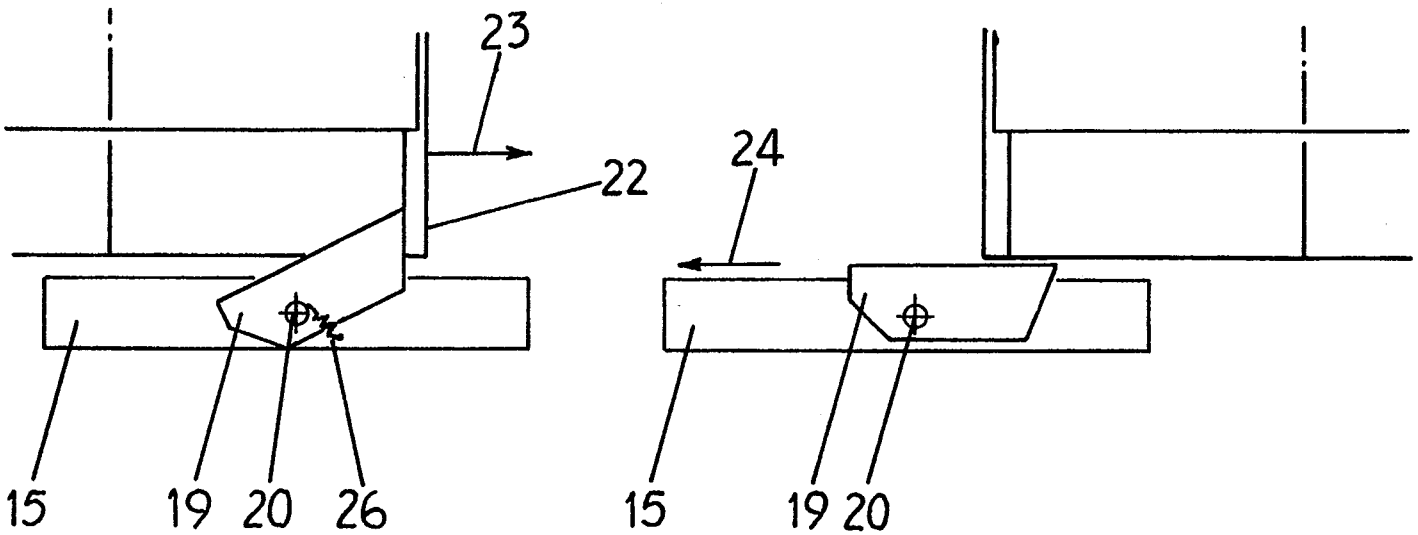
FIG. 3A
FIG. 3B

DEVICE FOR TRANSPORTING AND EXCHANGING CONTAINERS OF TEXTILE STRAND MATERIAL

FIELD OF THE INVENTION

The present invention relates to devices for transporting and exchanging containers of textile strand material and, more particularly, to a device for transporting and exchanging empty and full cans or containers at a textile machine, such as a spinning frame, draw frame, roving frame or similar machine processing strands of textile material.

BACKGROUND OF THE INVENTION

In the textile industry strands of textile material, such as slivers, are transported from and to processing machines, such as spinning frames, in containers, such as sliver cans. After filling or emptying, each container must be replaced by a fresh container—an empty or full one, depending on the circumstances. Containers of this type have been transported in the past by such means as slideways, roller conveyors, and suspended conveyors or conveyor belts.

A container changing and transporting device for spinning machines, wherein the transport paths consist of conveyor belts, is described in German Published, Examined Patent Application DE-AS 12 65 014. A corresponding device, wherein roller conveyors are used is disclosed in German Published, Non-Examined Patent Application DE-OS 38 09 287. In accordance with U.S. Pat. No. 3,716,979 it is also possible to transport the containers with conveyor chains on slideways between guide rails.

In all of the above-mentioned transport devices, rotating components or at least those which are moved continuously in one direction are used, which are quickly dirtied by the heavy flow of fibers and lint customary in textile plants in such a way that extensive cleaning becomes necessary. Cleaning of parts traveling in one direction is particularly difficult because of the fibers and lint wrapping themselves around the parts.

One disadvantage of these existing conveying devices, namely their considerable structural height, was overcome by a device described in U.S. Pat. No. 5,115,631. In this device, a straight push rod, movable in its longitudinal direction, is provided, which has a pusher which is immovably attached to it and extends in a plane oriented radially to the long axis of the rod. However, this push rod is only suited for transporting containers along straight courses.

A container transport system with slideways for containers is described in U.S. Pat. No. 4,537,018. The slideways have a support plate with a slit located approximately in the center, through which a transport hook normally extends upward. During movement the transport hook engages a lower edge of a spinning container and thereby moves the container. Each transport hook is fastened on a chain which is continuously moved forward in the transport direction, and because of this movement the chain is exposed to soiling to a large degree.

U.S. Pat. No. 3,125,782 describes a container transport device having push rods which can be lowered below a transport plane and carry hooks fastened immovably thereon. The rods are mounted so that they can be rotated, longitudinally and also lifted and lowered. This device presents considerable disadvantage in that the transporting device is moved in only one direction and that thick fiber wrappings stick to the parts when used in textile operations. A further disadvantage of the last mentioned device consists in that a separate drive is needed for each individual straight transport path in order to allow the device to make turns.

SUMMARY OF THE INVENTION

It is an object of the present invention to provide a container transporting and exchanging device that reduces the cleaning problems presented by existing transport devices and provides an efficient, effective and simplified device.

This and other objects of the present invention are attained in accordance with the present invention, which, briefly described, includes, in a device for transporting and exchanging containers of textile strand material at a textile strand processing machine having a plurality of processing stations, a guide device for guiding containers in a transport path extending around the machine past the processing stations. The transport path has straight sections and corner sections connecting the straight sections. An inserting station at which containers may be inserted into the transport path is also provided, along with a discharging station at which containers may be discharged from the transport path. An endless drive connection reciprocally movable in the transport path and having flexible portions reciprocally movable through the corner sections of the transport path is included, as well as a drive for reciprocally driving the drive connection for reciprocation in the transport path. Container engaging elements are also provided which project from and at spacings along the drive connection in the straight sections of the transport path for drivingly engaging containers during movement of the drive connection in one direction and out of driving engagement with containers during movement of the drive connection in the opposite direction, thereby step-wise advancing the containers along the transport path.

The endless drive connection includes rods disposed in the straight portions of the transport path which are connected to the flexible portions. The rods are of a length to remain between the corner sections during reciprocal movement of the endless drive connection. The container engaging elements may comprise pawls mounted on transverse shafts. The pawls may be spring biased into container engaging dispositions.

The containers may have bottom rims and the pawls may be disposed for engaging the bottom rims during movement of the pawls in one direction and are depressed by the rim to pass thereunder without driving the containers, during movement of the pawls in the other direction. The distance between the adjacent container engaging elements on the transport path may vary from one container engaging element to the next container engaging element for different pairs of the container engaging elements. The distance from one of the container engaging elements to the next container engaging element on the transport path is preferably adapted to requirements at each respective position of the machine. A sprocket may be disposed in each corner section and the flexible portions each comprise a chain trained sprocket. Alternatively, a pulley may be disposed in each corner section, and the flexible portions each comprise a belt and a plurality of pulleys and the belt travels over the pulleys. The drive may act directly on at least one of the rods, sprockets or pulleys located at said corner sections and the flexible portions, which are the aforementioned chains or belts.

BRIEF DESCRIPTION OF THE DRAWINGS

FIGS. 2A and 2B are elevational views of a portion of the machine and device of FIG. 1; and FIGS. 3A and 3B are further enlarged views of the portion of FIG. 2.

DETAILED DESCRIPTION OF THE PREFERRED EMBODIMENT

Figure 1:
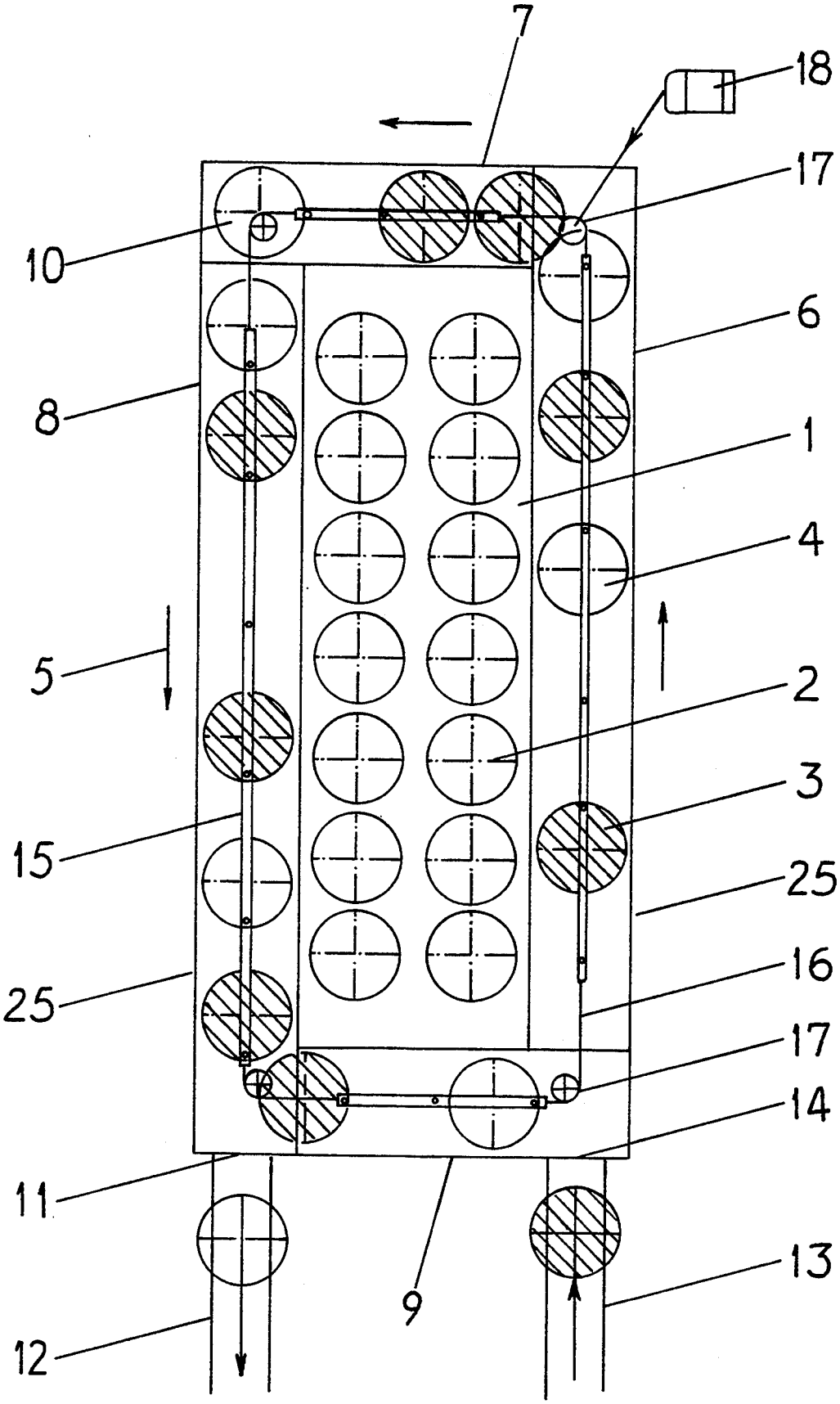
FIG. 1 is a schematic plan view of the sliver container positions of a spinning machine having a device for transporting and exchanging containers of textile strand material incorporating the preferred embodiment of the present invention.

The textile machine of FIGS. 1, 2A and B, and 3A and B may be an open-end spinning machine or any other type of spinning machine, roving frame, draw frame or other textile strand processing machine. Typically, open-end spinning machines require one active container or sliver can 2 per spindle. Generally, a can 2 is located underneath the associated spindle. Typically, at least one full reserve spinning can 3 is located around the machine 1. If a can 2 has been emptied at a spindle, the empty can is placed onto an empty spot on the transport path 5 and it is replaced by the full can 3.

In the machine of FIG. 1 full cans 3 and empty cans 4 are guided around the machine on a single endless transport path 5. Transport of the cans takes place in one direction only on the path 5, as indicated by the arrows of FIG. 1. Conventional guide means such as rails 25 for guiding cans 2 in the transport path 5 are provided to maintain the cans in the transport path.

The transport path 5 preferably consists of straight sections 6 and 8 on the longer sides 7 and 9 of the spinning machine 1 and on the ends of the spinning machine 1 with the straight sections being connected by corner sections 10. The full and empty cans 3,4 are transferred at the corner sections 10 of the path to the next straight sections 6 to 9 on the transport path.

Generally only the full cans 3 are transported completely around the machine 1. The empty cans 4 are taken out of the circuit at a discharging station 11 and are pushed onto a discharging path 12. Once an empty can 4 has been removed from the circuit, a fresh full can 3 from a supply path 13 may be inserted onto the transport path at an inserting station 14.

The drive connection of the transport path 5 is composed of transport rods 15 respectively in the straight transport sections 6 to 9, and of flexible portions, for example, chains 16 running over sprockets 17 or belts running over pulleys. The sprockets 17 or pulleys are located at the corner sections 10 of the transport path 5. The chains 16 connect the individual rods 15 of FIGS. 1 and 2 in such a way that a closed transport ring results. The endless drive connection is reciprocally movable in the transport path and the flexible portion is reciprocally movable through the corner sections of the transport path. The rods 15, chains or belts 16 and sprockets or pulleys 17 should be disposed below the surface on which the cans are moved along. This results in a flat upper side of the associated transport path which, because of the simple mechanism, can be placed flat on the mill floor so that it represents only a negligible obstacle for cross traffic and allows operators to pass without danger.

The transport device of the invention preferably has only a single drive means 18 which can act on one of the sprockets or pulleys 17 or one of the rods 15 or one of the belts or chains 16. The drive means 18 reciprocally drives the drive connection for reciprocation in the transport path.

In accordance with FIG. 2, each one of the transport rods has container engaging elements 19, which may be pawls, located at preset distances apart and, as shown in FIGS. 3A and B, are mounted on transverse shafts 20 which are limited in their pivot movement so that when they are moved in the transport direction 23, they engage the lower rim 22 of a can wall 21. When moved in the return direction 24, they are depressed by the can and glide under the rim 22. The pawls 19 are biased in their upward cam rim engaging position by conventional means, such as coil springs 26 wound on the transverse shafts 20 with ends engaging the pawls. As seen in FIG. 3A.

The distance from one pawl to the next should be adapted to the requirements of each machine. The individual stroke of reciprocation of the device is greater than the greatest spacing of pawls 19. The stroke and disposition of the pawls 19 on the rods 15 are arranged in such a way that, at a corner section 10, a can is pushed from behind the front of the rim far enough with a first stroke of a pawl that at the respectively next stroke the pawl, after retracting under the rear of the can rim, engages on the next forward stroke the outside rim of the rear of the stroke to move the can fully into the corner section 10.

The pawls 19 can be arranged on the respective rod 15 at an approximate distance from each other a, which is greater by a small amount than the can diameter D. This difference approximately corresponds to the thickness d of the can wall 21 at its lower edge 22 or rim. Maximally the distance from pawl to pawl 19 may be almost equal to two can diameters. The distance a between the pawl 19, on the individual rods 15 may change from position to position and/or from pawl pair to pawl pair, so as to adapt, by a pawl's stroke, the end position of the individual cans 3,4, to the requirements of the respective position on the machine periphery, for example at the discharging stations 11, 14 of the machine. The distance a may also vary to reduce the start-up drive force because, with the spatially varied pawl distances, the engaged cans can be put into motion sequentially or at least at two different times. The latter alternative is advantageous for technical drive reasons. This results in the possibility of making the drive output correspondingly less.

Due to the fact that in accordance with the invention the rods 15 are connected with each other at the four corners of the machine 1 via flexible portions 16 such as chains or belts, which run over sprockets or pulleys 17, in such a way that the path formation consisting of rods and flexible portions extends around the entire machine in the shape of a closed transport path 5, it is possible to reciprocate the device, with the length of the flexible portions being greater than the stroke of reciprocation to prevent the rods from entering the corner sections. If the pawls 19 are fixed on each one of the rods 15, it is possible in this way to convey all of the cans standing on the transport path 5 in steps around the machine 1 by means of the endless drive connection reciprocally movable in the transport path.

According to the invention, it is possible to operate with only a single drive means 18, preferably a stepped switch motor, for the entire transport of the full and empty cans around the machine 1. The sole drive means 18 can act on a sprocket or pulley 17 or directly on a rod 15.

The single transport drive means 18 in accordance with the invention can act directly on a rod 15, preferably from below, so that it does not interfere with the containers or cross traffic, but it can also be connected with one of the sprockets or pulleys 17 at one of the four corner sections 10.

It is provided in further accordance with the invention that at the can inserting 14 or discharging 11 positions of the transport path 5, (i.e., at a shunt from one machine's transport circuit to another machine's transport circuit), empty or full cans may be directed to different transport paths by defined switching on or off of individual pawls 19. For example, it is possible to distribute empty or full cans which were delivered together on a first transport path at a shunt (or insertion/removal position) to different ongoing transport paths.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A device for transporting and exchanging containers of textile strand material at a textile strand processing machine having a plurality of processing stations, said device comprising:

(a) guide means for guiding containers in a transport path extending around the machine past the processing stations, said transport path having straight sections and corner sections connecting the straight sections;

(b) an inserting station at which containers may be inserted into the transport path;

(c) a discharging station at which containers may be discharged from the transport path;

(d) an endless drive connection reciprocally movable in the transport path and having flexible portions reciprocally movable through the corner sections of the transport path;

(e) drive means for reciprocally driving said drive connection for reciprocation in the transport path; and (f) container engaging elements projecting from and at spacings along said drive connection in the straight sections of the transport path for drivingly engaging containers during movement of the drive connection in one direction and out of driving engagement with containers during movement of the drive connection in the opposite direction, thereby step-wise advancing the containers along the transport path.

2. A device for transporting and exchanging containers according to claim 1 wherein said endless drive connection includes rods disposed in said straight portions of the transport path and connected to said flexible portions, said rods being of a length to remain between said corner sections during reciprocal movement of said endless drive connection.

3. A device for transporting and exchanging containers according to claim 1 wherein said container engaging elements comprise pawls mounted on transverse shafts.

4. A device for transporting and exchanging containers according to claim 3 wherein said pawls are spring biased into container engaging dispositions.

5. A device for transporting and exchanging containers according to claim 4 wherein the containers have bottom rims and said pawls are disposed for engaging the bottom rims during movement of said pawls in one direction and are depressed by the rim to pass thereunder without driving the containers, during movement of said pawls in the other direction.

6. A device for transporting and exchanging containers according to claim 1 wherein the distance between adjacent container engaging elements on said transport path varies from one said container engaging element to the next said container engaging element for different pairs of said container engaging elements.

7. A device for transporting and exchanging containers according to claim 6 wherein the distance from one of said container engaging elements to the next said container engaging element on said transport path is adapted to requirements at each respective position of the machine.

8. A device for transporting and exchanging containers according to claim 2 wherein a sprocket is disposed in each corner section and said flexible portions comprise chains trained around said sprockets.

9. A device for transporting and exchanging containers according to claim 8 wherein said drive means acts directly on at least one of said rods, sprockets and chains.

10. A device for transporting and exchanging containers according to claim 1 wherein a pulley is disposed in each corner section and said flexible portions comprise belts trained around said pulley.

11. A device for transporting and exchanging containers according to claim 10 wherein said drive means acts directly on at least one of said rods, pulleys and belts.

* * * * *